United States Patent [19]

Freedman et al.

[11] 4,398,077

[45] Aug. 9, 1983

[54] MICROWAVE COOKING UTENSIL

[75] Inventors: George Freedman, Wayland; Palmer P. Derby, Weston, both of Mass.

[73] Assignee: Raytheon Company, Lexington, Mass.

[21] Appl. No.: 291,135

[22] Filed: Aug. 7, 1981

Related U.S. Application Data

[63] Continuation of Ser. No. 194,167, Oct. 6, 1980, abandoned.

[51] Int. Cl.[3] ..... H05B 6/64

[52] U.S. Cl. ..... 219/10.55 E; 219/10.55 F; 99/451; 99/DIG. 14; 426/243

[58] Field of Search ..... 219/10.55 E, 10.55 F, 219/10.55 R, 10.55 M; 426/107, 243; 99/451, DIG. 14

[56] References Cited

U.S. PATENT DOCUMENTS

| | | | |
|---|---|---|---|
| 3,731,037 | 5/1973 | Levinson | 219/10.55 E |
| 3,845,266 | 10/1974 | Derby | 219/10.55 E |
| 3,854,023 | 12/1974 | Levinson | 219/10.55 E |
| 3,941,967 | 3/1976 | Sumi et al. | 219/10.55 E |
| 3,965,323 | 6/1976 | Forker, Jr. et al. | 219/10.55 E |
| 4,027,132 | 5/1977 | Levinson | 219/10.55 E |
| 4,184,061 | 1/1980 | Suzuki et al. | 219/10.55 F X |
| 4,190,757 | 2/1980 | Turpin et al. | 219/10.55 E |
| 4,210,124 | 7/1980 | Husslein et al. | 219/10.55 E |
| 4,267,420 | 5/1981 | Brastad | 219/10.55 E |

*Primary Examiner*—B. A. Reynolds
*Assistant Examiner*—Philip H. Leung
*Attorney, Agent, or Firm*—William R. Clark; Joseph D. Pannone

[57] ABSTRACT

A microwave cooking utensil comprising a glass ceramic dish having a resistive film on the outside and a conductive layer covering substantially all of the inside to block the passage of microwave energy through the dish to the interior thereof. A conductive lid over the dish prevents the passage of microwave energy through the opening of the dish. During cooking, substantially all of the microwave energy is absorbed by the resistive film instead of the food so that searing temperatures are maintained.

15 Claims, 8 Drawing Figures

FIG. 3
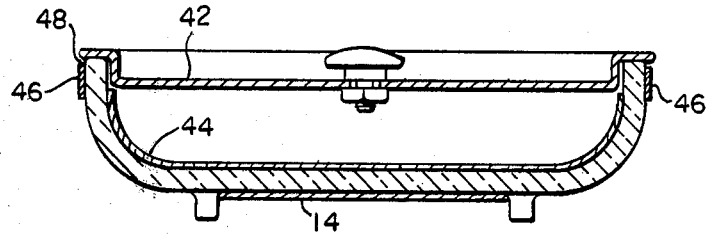
FIG. 4
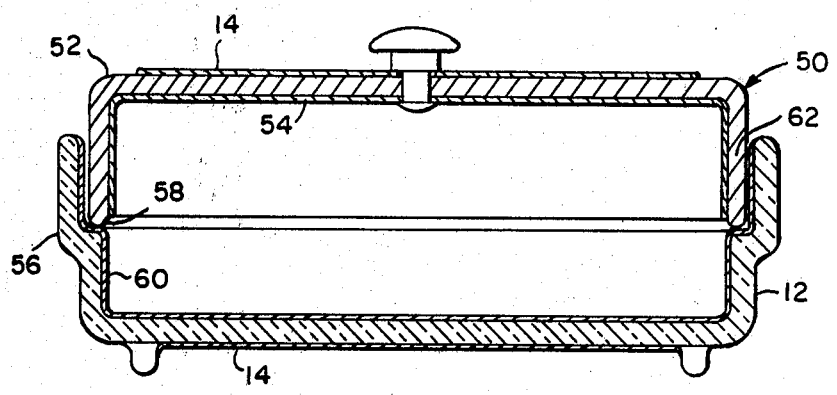
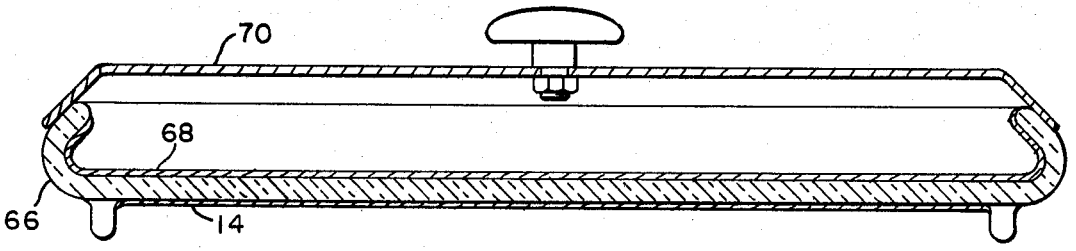
FIG. 5

MICROWAVE COOKING UTENSIL

CROSS-REFERENCE TO RELATED CASES

This is a continuation of application Ser. No. 194,167, filed Oct. 6, 1980, now abandoned.

BACKGROUND OF THE INVENTION

As is well known, microwave ovens cook food by a different principle than conventional gas or electric ovens. With conventional ovens, the oven cavity is generally preheated to a particular temperature and the food is placed therein for a specified time period during which the heat conducts inward in the food. The relatively high temperature on the surface of the food causes browning or searing of the surface of the food. With microwave ovens, the food body is generally heated throughout by molecular agitation in the microwave field. Because the surface temperature and exposure time are considerably less than with conventional cooking, microwave ovens do not provide browning or searing of food. There has been a recognized need to enhance the appearance of some foods cooked in microwave ovens and thereby increase their palatability.

One prior art approach to the appearance problem was the introduction of combination ovens. More specifically, the food is cooked simultaneously by microwave energy and heat provided by a conventional electric element or gas convection. Combination ovens have enjoyed consumer acceptance and success in the marketplace. They provide much more rapid cooking as characterized by microwave heating and the appearance of the food is satisfactory. Combination ovens, however, are relatively expensive and there is a need to provide the consumer who has already purchased a microwave oven with a means for browning or searing food.

Even before the introduction of combination ovens, many browning dishes were available to the consumer. Generally, these dishes converted microwave energy to heat which, by conduction, presented relatively high temperatures to the surface of the food. Two materials that are used to convert microwave energy to heat are ferrites and resistive films. The ferrites may be particulate with a particular size as determined by the microwave frequency. Also, the ferrites may be dispersed throughout a medium which may be part of a microwave transparent dish or be in a form of a monolithic ceramic body which may constitute all or part of the dish. The resistive films, which have also been referred to as semiconductor or electroconductive films in the art, generally cover a portion of the outside surface of a dish. The most common resistive film is tin oxide. In operation, the dish is placed in the microwave oven to preheat and then the food is placed in the dish. This method provides some searing or browning but not to a degree to satisfy most consumers. The problem is twofold. First, as soon as the food is placed in the dish, a substantial portion of the microwave energy in the microwave field is coupled to it leaving much less to be converted to heat in the resistive film. The result is that the temperature provided by the resistive film is much less than with the no-food load condition. Second, because the food cooks much faster in a microwave oven than in a conventional one, the exposure time period to the browning heat is much less than with a conventional oven.

SUMMARY OF THE INVENTION

The prior art browning utensil problems discussed herein have been solved by the invention wherein the food is shielded from the microwave energy. As a result thereof, the temperature provided to the surface of the food during cooking is much higher than with prior art utensils; furthermore, the searing temperatures can be provided for a longer period of time without overcooking the food.

The invention discloses the combination of a microwave transparent layer having a resistive film on one side and a conductive layer on the other side.

The invention discloses a microwave oven cooking utensil comprising a microwave transparent dish, a layer of resistive material positioned over at least a portion of the outside surface of the dish, and a conductive layer adjacent to a substantial portion of the inside surface of the dish. By microwave transparent, it is meant that microwave energy can pass through the dish without substantial loss. Preferably, the microwave transparent material is a glass ceramic such as commonly used in microwave ovens. The resistive material may preferably be a tin oxide. Also, the conductive layer which blocks the passage of microwave energy therethrough may preferably be aluminum. Resistive materials, such as tin oxide, heat efficiently in a microwave field, but they must be spaced from a conductive surface for there to be enough voltage potential so that significant energy is coupled to the film. The microwave transparent dish ideally provides this spacing. The preferable spacing is dependent on the wavelength of the microwave energy in the spacing which is a function of the dielectric coefficient of the spacing material. For a microwave oven frequency of 2450 megacycles, and a conventional glass ceramic dish, a dish thickness of 3 millimeters was found to be adequate.

The invention may also be practiced by a microwave oven cooking utensil comprising a microwave transparent dish having an opening for placing a food body therein, a layer of resistive material positioned over at least a portion of the outside surface of the dish, and means for substantially preventing the transfer of microwave energy from the exterior to the interior of the dish, the means comprising the combination of a conductive layer covering the inside of the dish and a conductive lid removably positioned over the opening. The combination of the conductive layer and conductive lid substantially isolate the the food within the dish from the microwave field.

Because conductive surfaces adjacent to each other in a microwave field may arc, it may be preferable that the conductive layer and conductive lid be spaced and configured so as to provide sufficient spacing as to inhibit arcing and to provide some microwave choking through the gap therebetween. The choke need not be so efficient as the door seals as required by the government and safety regulations; some leakage of microwave energy to the interior of the dish does not substantially impact the advantages of the utensil.

It may be preferable that the removable conductive lid overlap the dish such that the lid is substantially parallel with the conductive layer for a distance which is perpendicular to the perimeter of the lid around the perimeter of the lid. Furthermore, it may be preferable that the distance be an odd multiple of one-quarter wavelength of the microwave energy in the dish medium therebetween.

The invention may also be practiced by a microwave oven cooking utensil comprising a microwave transparent lid having a layer of resistive material positioned over at least a portion of the outside thereof and a conductive layer adjacent to a substantial portion of the inside thereof.

BRIEF DESCRIPTION OF THE DRAWINGS

The foregoing and a description of preferred embodiments will be more clear with reference to the drawings wherein:

FIG. 3 is an alternate embodiment of a microwave oven cooking utensil showing a recessed lid and conductive layer over a portion of the outside of the dish;

FIG. 4 is an alternate embodiment of a microwave oven cooking utensil showing resistive film on the top and bottom and a lid that fits inside the dish;

FIG. 5 is an alternate embodiment of a microwave oven cooking utensil having advantage as a pizza maker;

DESCRIPTION OF THE PREFERRED EMBODIMENT

Figure 1:
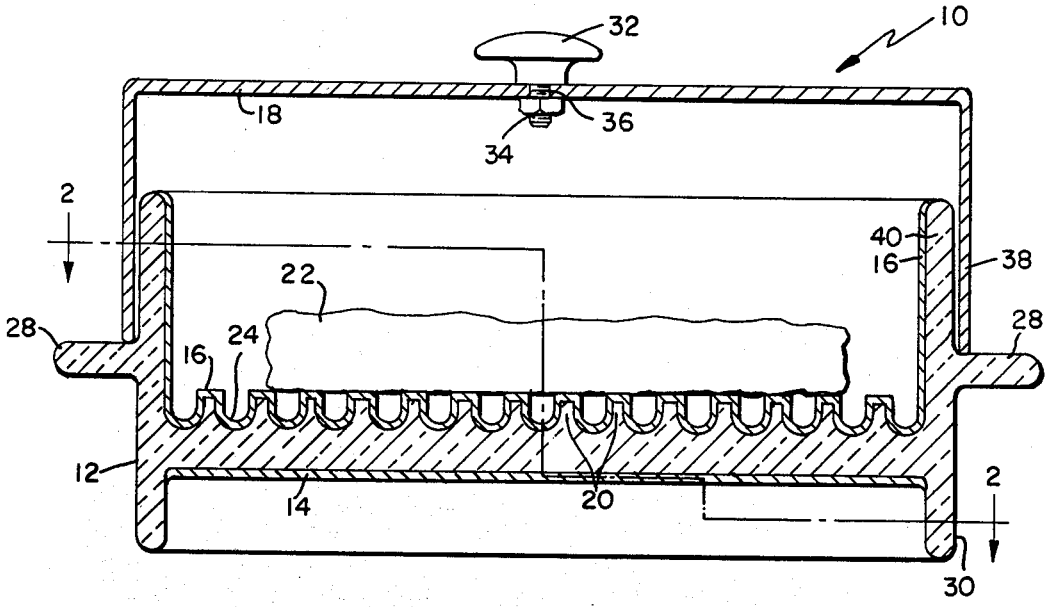
FIG. 1 is a cut-away view side elevation of a microwave oven cooking utensil embodying the invention.

Referring to FIG. 1, there is shown a cross-section side view of a microwave utensil 10 embodying the invention. Utensil 10 comprises a dish 12 having a resistive film 14 covering a portion of the outside and a conductive shield 16 covering a substantial portion of the inside. Utensil 10 also comprises lid 18.

Dish 12 is fabricated of a conventional crystallized glass (glass ceramic) material which is transparent to microwave energy, has a high heat capacity, and has a low coefficient of expansion. Other suitable materials for dish 12 are ceramic, glass, glass porcelain and synthetic resin such as florine-contained resin, polypropylene, polyethylene, polystyrene, polyester or other similar microwave transparent high temperature plastics.

Figure 2:
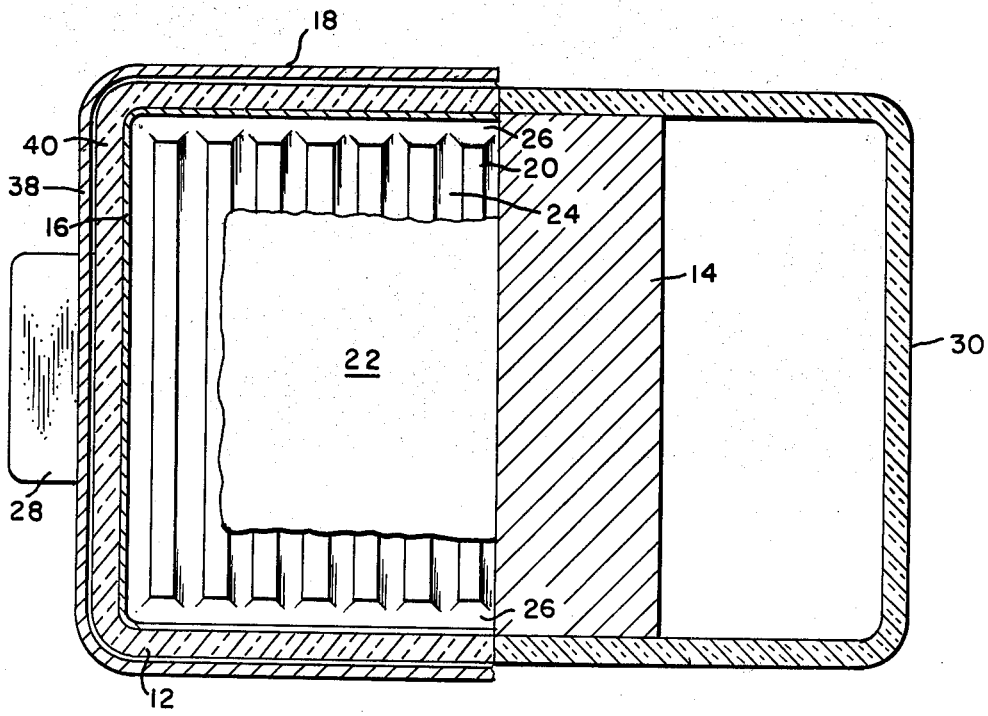
FIG. 2 is a multiple level cut-away top view of the utensil of FIG. 1 taken along line 2—2.

As shown in FIG. 2, which is a multiple level cut away view of the utensil of FIG. 1 taken along line 2—2, the dish is substantially rectangular in shape with rounded corners. Other common cooking utensil shapes such as circular or oval could also be used. The inside bottom surface of dish 12 has a plurality of parallel upraised ridges 20. As will be described in detail later herein, food body 22 placed within the dish is seared by conduction heat from the inside bottom surface. Ridges 20 function to concentrate the searing heat to provide darkened lines similar to grill marks are present with steaks and the like that have been cooked on a charcoal grill. Many believe that these grill marks enhance the appearance and therefore, the palatability of steaks, chops, hamburgs, etc. Furthermore, the valleys 24 between the ridges provide troughs for collecting fats and oils flowing from cooking foods. The troughs may preferably be sloped in the horizontal plane so that fats and oils will drain to a reservoir 26 around the periphery of the bottom surface of the dish. It may be desirable that the ridges have a width between one-eighth inch and one quarter inch. In an alternate embodiment, the ridges may be rounded on top. The dish also has handles 28 protruding from the sides. The handles may also function as stops for lid 18 as it is placed over the dish. The thickness of dish 12 will be described later herein.

Resistive film 14 is a high loss tin oxide based composition such as is well known in the art. The film, which has been referred to in the art as semiconductive or electroconductive, may have an electrical resistance value in the range from 50 to 1,000 ohms per square but more preferably is in the range from 90 to 350 ohms per square. A resistance in the latter range makes the film efficiency heatable in a microwave energy environment. The thickness of the film may be in the range from 500 angstroms to 10,000 angstroms but more preferably is in the range from 1,000 angstroms to 7,000 angstroms. Resistive film 14 is deposited on the bottom outside surface of dish using well known technology such as described, for example, in U.S. Pat. No. 3,853,612. As will be described later, the film heats in the microwave environment, which heat conducts to food placed in the dish. Accordingly, it is preferable that film 14 cover that portion of the bottom outside surface of dish 12 that is adjacent to the inside searing surface upon which food is placed. For the dish shown in FIG. 1, film 14 covers slightly more than the area adjacent to the inside ridges, which area is substantially all of the horizontal surface area of the outside bottom of dish 12. Film 14 does not cover vertical support members 30 which are provided to elevate film 14 from the floor of the microwave cavity or from a plate within the cavity for supporting dishes; accordingly, the high temperature surface of film 14 during microwave exposure is not in direct contact with the bottom of the microwave cavity. Vertical support members 30 may preferably be a continuous bar around the periphery of the dish as shown or four legs at the corners.

Conductive shield 16 covers substantially all of the interior of dish 12. In essence, the inner surface of the dish is a metallic shroud that prevents the passage of microwave energy therethrough. Conductive shield 16 may be permanently attached to dish 12 by any one of a plurality of well known techniques such as, for example, electrolysis plating, metallizing or sputtering. The metallic conductive shield which may preferably be aluminum is generally deposited to a thickness as required by normal wear such as washing with detergents and scouring. For example, even though a thickness of less than 0.25 mils may be adequate to prevent the passage of microwave energy, a conductive shield of aluminum may preferably be 2 mils or thicker to resist normal wear and still perform the shielding function. Because of metallurgical considerations, it may be preferable to form shield 16 by depositing an evaporative coating of copper because it bonds well to glass ceramic substrates and the electroplate a layer of chromium over the copper. Also, shield 16 may be in the form of a removable metallic plate such as aluminum which conforms to the inner shape of the dish. The removability may make easier the task of cleaning after use.

Still referring to FIG. 1, utensil 10 also comprises lid 18. The lid functions to block the passage of microwave energy to food body 22 within dish 12 so it is fabricated of a conductive material. Aluminum may be a preferable fabrication material because of its lightness and durability. Lid 18 has a handle 32 which is affixed to the top center of the lid. A non-conductive bolt 34 extends through a small hole 36 in the lid and is secured to handle 34. The hole is below microwave cut off in size so there is substantially no leakage of microwave energy through it.

When placed over the dish, the sides 38 of lid 18 are approximately parallel to the sides 40 of the dish. Actually, the sides of the lid may be tapered slightly outward so as to provide easy removal of the lid from the dish. Accordingly, the conductive surfaces of the sides 38 of the lid are substantially parallel to the conductive shield around the periphery of the dish. Lid 18 lowers over dish 12 until the sides come in contact with dish handles 28. The combination of the side of lid 18 running parallel with the conductive shield forms a partial choke. The two surfaces are separated by a distance slightly larger than the thickness of the dish side. In operation, resistive film 14 is exposed to microwave energy and, as is well known in the art, heats as a result thereof. The heat so generated transfers by conduction through the dish and conductive shield to food body 22 resting on ridges 20, which food body is substantially isolated from the microwave energy field.

Generally, when a resistive film is exposed to a microwave energy field, the temperature of the film continues to rise until the radiation, convection, and conduction heat losses equal the heat being generated within the film. At that point, the temperature stabilizes. The physical geometries and the heat conductivities of the dish, conductive shield, and food determine in part the amount of heat losses of the resistive film. Typically, without a food body load in the dish, the stabilizing temperature of resistive films on commercially available dishes is in the range from 350° F. to 600° F. With prior art resistive dishes, however, when a food body is placed in the dish, the temperature of the resistive film is drastically reduced. This is due in part to quenching by food juices or conduction into the food. Furthermore, once reduced, the temperature does not recover to the searing level. An important factor in this phenomenon is that substantially less heat is generated in the film because a significant portion of the microwave energy is coupled to the food rather than the film. With the embodiment of FIG. 1, the food body is substantially isolated from the microwave energy by the combination of conductive shield 16 and lid 18 so that the temperature of the film rises to and stays at a searing temperature. Futhermore, with the food being substantially isolated from the microwave field, essentially all of the cooking is effected by the conduction heat rather than rapid microwave cooking so that the food is able to sear for a longer period of time.

Electrical arcing between conductive or metallic surfaces in close proximity in a microwave field is a common phenomenon. Accordingly, it is desirable to provide a spacing between conductive shield 16 and lid 18 that respectively block the passage of microwave energy through the dish and its opening. For effective operation of the cooking utensil, microwave energy does not have to be blocked from the interior of the dish to the same degree as microwave energy has to be sealed by the door of a microwave oven to comply with government regulations and safety constraints. However, it is preferable to suppress the leakage of microwave energy through the gap between shield 16 and lid 18 so that there is adequate isolation of the food from the microwave field. That isolation is provided by the structure of FIG. 1. More specifically, it is preferable that the conductive surfaces of lid 18 and conductive shield 16 be adjacent and substantially parallel in a direction perpendicular to the periphery of them for a distance approximately equal to an odd multiple of one-quarter wavelengths of the microwave energy in the dielectric between them. Assuming the entire gap between the conductive surfaces is filled with a glass ceramic in which microwave energy at a frequency of 2450 megacycles has a one quarter wavelength of 0.45 inches, the most effective distances of being adjacent are 0.45, 1.35, 2.25 inches, etc. This configuration provides a maximum impedance mismatch between the surfaces resulting in a minimum energy transfer through the gap therebetween. It is noted, however, that parallel distances other than the ideal distances will still provide some suppression of leakage into the interior of the dish. Also, as the distance is increased, the transfer of energy is generally decreased. Furthermore, as the thickness of the dish side is decreased, a smaller percentage of microwave energy passes. With the structure shown in FIG. 1, it was found that the microwave field intensity inside the utensil was less than 1% of the intensity outside the utensil.

Although ferrites in contact with a metal surface couple well to microwave energy, semiconductive or resistive films must be displaced a certain distance from the metal surface to benefit from the full microwave voltages. Tests have demonstrated that if a film is too close to a metal layer, there will not be enough voltage potential for it to absorb microwave energy and heat up. An adequate separation distance of the film from the conductive shield through the dish glass ceramic dielectric has been found to be about three millimeters. Because ceramic dishes are generally thicker than three millimeters for structural reasons, the minimum thickness of the dish for microwave coupling reasons was not considered to be a design constraint.

FIGS. 3–7 show alternate embodiments of the invention and different cooking utensil applications. For example, referring to FIG. 3, there is shown a recessed lid wherein the partial choking structure is provided by the combination of the lid 42, conductive shield 44 lining a substantial portion of the interior of the dish, and conductive shield 46 on the outside of the dish. Gaps 48 are provided between the conductive surfaces to prevent arcing.

Referring to FIG. 4, an embodiment of the invention for a bake box is shown. More specifically, resistive film 14 is provided on both the top and the bottom of the heating area. Lid 50 is fabricated of the same material as dish 12 described with reference to FIG. 1. More specifically, there is an outer layer of resistive film 14, a layer of glass ceramic and an inner metallic layer forming a conductive shield 54. With this embodiment, the conductive heat enters the interior of the dish from both the top and bottom making the distribution of heat more uniform. Still referring to FIG. 4, an alternate embodiment of the partial choke structure is shown. Lid 50 slides down into dish 56 until it contacts lip 58. Conductive shield 54 of lid 50 is separated from conductive shield 60 of dish 56 by gap 62 at the lip. Conductive shields 54 and 60 are parallel to form a partial choke as described with reference to FIG. 1.

Referring to FIG. 5, an application of the invention for a pizza maker is shown. The heat enters the interior of the utensil from the bottom only as the resistive film 14 is below dish 66. Also, an alternate embodiment of the partial choke is shown whereby the conductive shield 66 lining the interior of dish 66 runs parallel to metal lid 70 which rests on top of the inward sloped sides of the dish.

Figure 6:
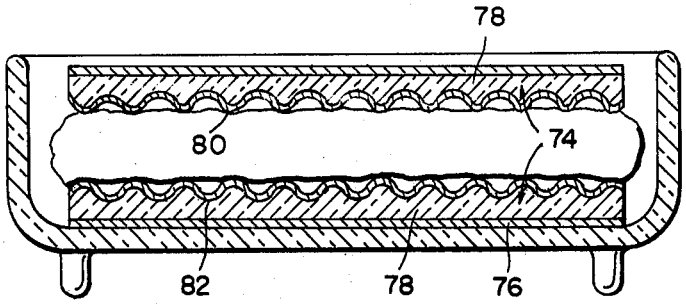
FIG. 6 is an alternate embodiment of a microwave oven cooking utensil having advantage as a hamburger maker.

Referring to FIG. 6, a hamburger maker is shown. In this alternate embodiment, two identical heating elements 74 are shown. Each has a resistive film 76 on the outside of a glass ceramic structure 78 having round top ridges 80 on the interior. A conductive shield 82 is positioned over the ridges to provide some shielding of hamburger 80 from the microwave environment.

Figure 7:
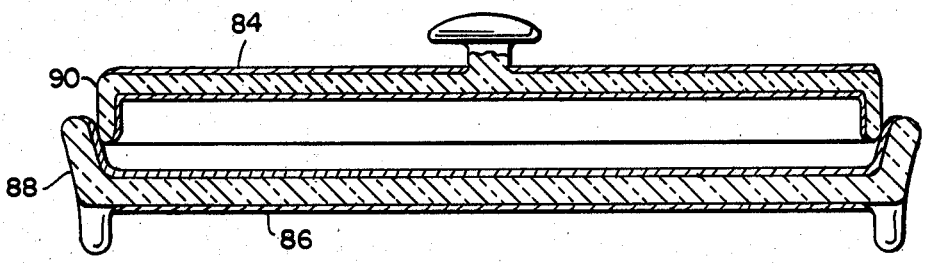
FIG. 7 is an alternate embodiment of a microwave oven cooking utensil.

Referring to FIG. 7, a toaster is shown. Heat enters the dish interior from both the top and bottom from resistive films 84 and 86. These films are attached to the glass ceramic dish 88 and glass ceramic lid 90. A choke structure similar to the one shown in FIG. 4 is used in this alternate embodiment.

Figure 8:
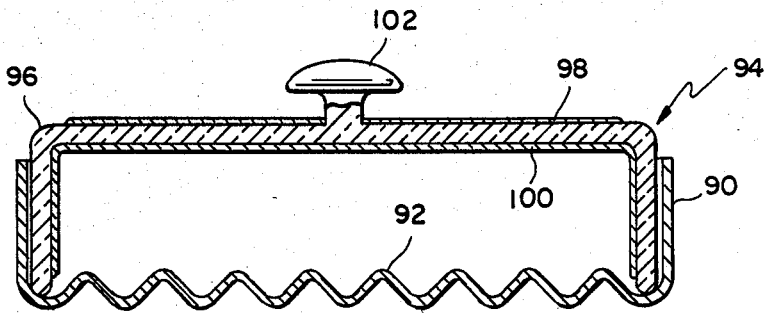
FIG. 8 is an alternate embodiment of a microwave oven cooking utensil.

Referring to FIG. 8, an alternate embodiment of a microwave cooking utensil is shown. In essence, the dish and lid structures described earlier herein are reversed. More specifically, the food supporting portion of the utensil is a conductive vessel 90 that may preferably have ridges 92 for raising the food so that grease and oils can run off. The lid portion 94 comprises a glass ceramic form 96 having a resistive film 98 on the outside and conductive shield 100 on the inside. With this embodiment, conductive shield 100 from which substantially all of the heat energy is radiated to the food is not quenched by the food when it is placed in the utensil. Handle 102 may be a part of ceramic form 96.

This concludes the description of the preferred embodiments. From the reading hereof, many alterations and modifications will become apparent without departing from the spirit and scope of the invention. Accordingly, it is intended, that the scope of the invention be limited only by the appended claims.

What is claimed is:

1. A microwave oven cooking utensil comprising:

a microwave transparent dish having an opening for placing a food body therein;

a layer of resistive material positioned over at least a portion of the outside surface of said dish; and means for substantially shielding the interior of said dish from microwave energy, said means comprising the combination of a conductive layer covering a substantial portion of the inside of said dish and a conductive lid removably positioned over said opening.

2. The utensil recited in claim 1 wherein said microwave transparent dish comprises a glass ceramic material.

3. The utensil recited in claim 1 wherein said resistive material comprises tin oxide.

4. The utensil recited in claim 1 wherein said conductive layer comprises aluminum.

5. A microwave oven cooking utensil comprising:

a microwave transparent dish having an opening for placing a food body therein;

a resistive layer covering at least a portion of the outside surface of said dish;

a conductive layer covering substantially all of the inside surface of said dish to block the passage of microwave energy through said dish to the interior thereof; and a conductive lid removably positioned over said opening to block the passage of microwave energy through said opening to the interior of said dish.

6. The utensil recited in claim 5 wherein said transparent dish comprises a glass ceramic material.

7. The utensil recited in claim 5 wherein said resistive layer comprises tin oxide.

8. The utensil recited in claim 5 wherein said conductive layer comprises aluminum.

9. A microwave oven cooking utensil comprising:

a microwave transparent dish having an opening for placing a food body therein;

a resistive film covering at least a portion of the outside surface of said dish;

a conductive layer covering a substantial portion of the inside surface of said dish to block the passage of microwave energy through said dish to the interior thereof; and a removable conductive lid covering said opening and overlapping said dish, said lid being substantially parallel with said conductive layer for a distance perpendicular to the perimeter of said lid around the perimeter of said lid wherein the parallel portions of said lid and said conductive layer provide suppression of microwave energy leakage through the gap therebetween to the interior of said dish.

10. The utensil recited in claim 9 wherein said transparent dish comprises a glass ceramic material.

11. The utensil recited in claim 9 wherein said conductive layer comprises aluminum.

12. A microwave oven cooking utensil comprising:

a microwave transparent lid;

a layer of resistive material positioned over at least a portion of the outside surface of said lid;

a conductive layer adjacent to a substantial portion of the inside surface of said lid; and a dish adapted for being covered by said lid, said dish being conductive to microwave energy for substantially shielding the interior of said dish from microwave energy when said lid is positioned over said dish.

13. The utensil recited in claim 12 wherein said transparent lid comprises a glass ceramic material.

14. The utensil recited in claim 12 wherein said resistive material comprises tin oxide.

15. The utensil recited in claim 12 wherein said conductive layer comprises aluminum.

* * * * *